US007377246B2

(12) United States Patent
Maassen

(10) Patent No.: US 7,377,246 B2
(45) Date of Patent: May 27, 2008

(54) VERTICALLY ORIENTED CAMSHAFT CAP OIL DIVERTER

(75) Inventor: Erik C. Maassen, Livonia, MI (US)

(73) Assignee: GenTek Technologies Marketing Inc., Parsippany, NJ (US)

( * ) Notice: Subject to any disclaimer, the term of this patent is extended or adjusted under 35 U.S.C. 154(b) by 767 days.

(21) Appl. No.: 10/908,256

(22) Filed: May 4, 2005

(65) Prior Publication Data

US 2006/0249112 A1 Nov. 9, 2006

(51) Int. Cl.
*F01M 1/06* (2006.01)

(52) U.S. Cl. ..... 123/90.34; 123/90.33; 123/90.38; 123/196 M

(58) Field of Classification Search ..... 123/90.34, 123/90.33, 90.38, 196 M
See application file for complete search history.

(56) References Cited

U.S. PATENT DOCUMENTS 5,325,826 A 7/1994 Cierpial
5,704,330 A * 1/1998 Tsuchida ..... 123/193.5

* cited by examiner

*Primary Examiner*—Zelalem Eshete
(74) *Attorney, Agent, or Firm*—Arthur J. Plantamura

(57) ABSTRACT

An improved cam shaft configuration for internal combustion engines is provided wherein the oil is efficiently diverted from the camshaft cap to adjacent camshaft lobes. A reorientation of the camshaft oil diverter improves the distribution and increases the quantity of oil flow without building in additional oil passages to supply oil to cams, that would introduce additional expense without substantially alleviating existing prior art lubrication deficiency problems. The invention obviates the known prior art configurations that suffer from the drawback of insufficient distribution of lubricating oil to adjacent camshaft lobes that is effected by oil diverter configurations.

8 Claims, 14 Drawing Sheets

(Invention)

Fig. 3 (Invention)

Fig. 4 (Invention)

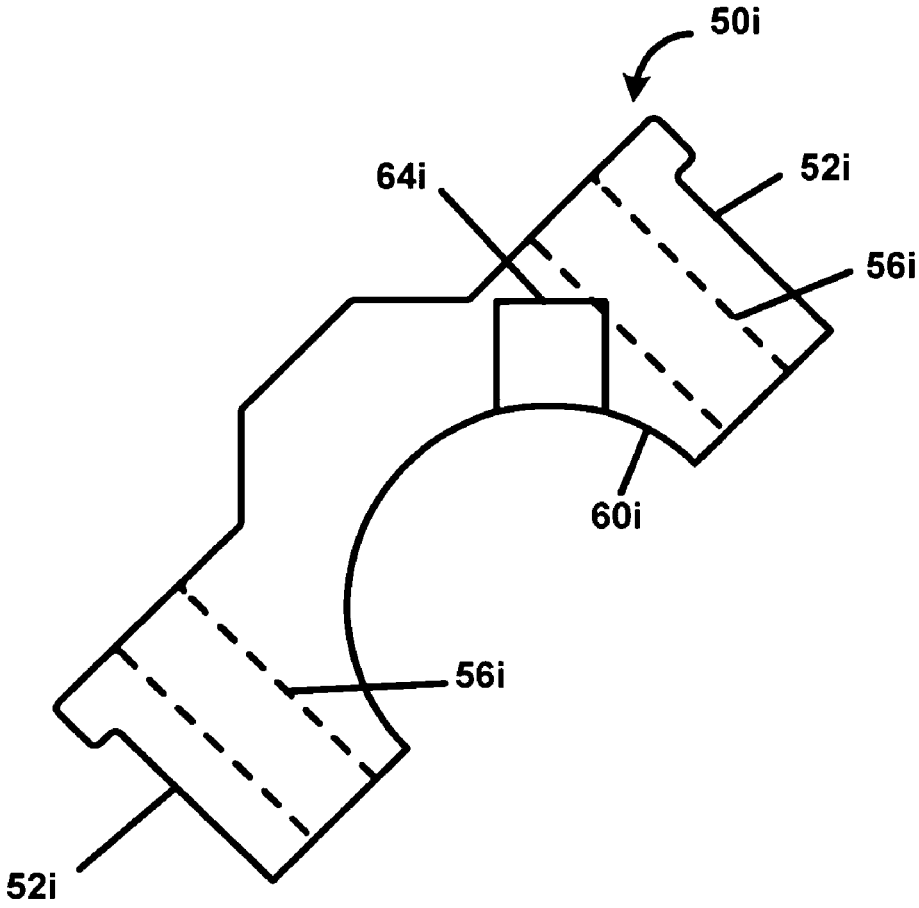
Fig. 9 (Invention)
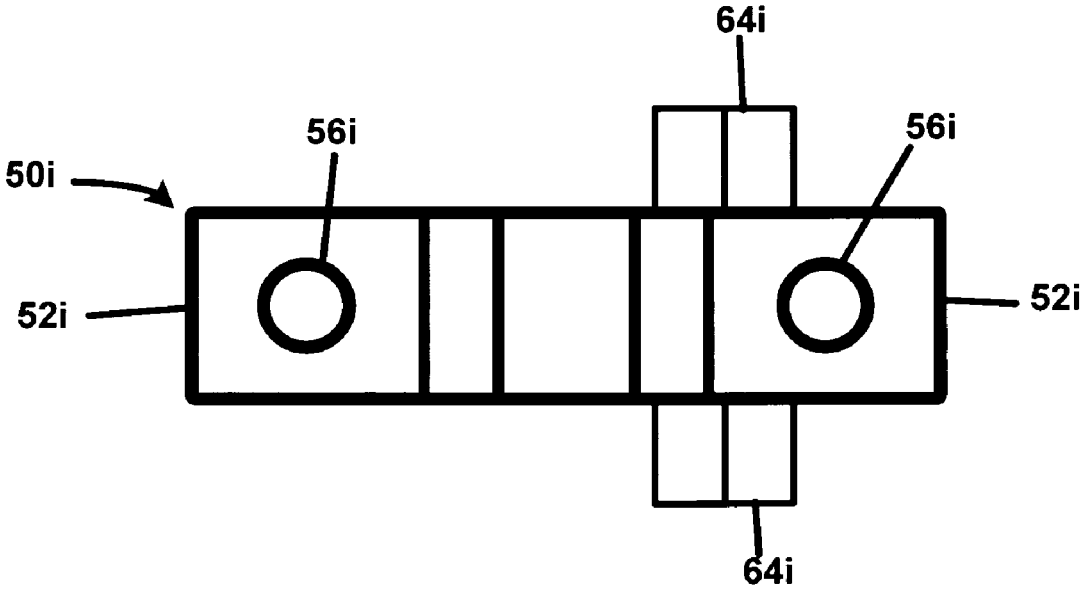
Fig. 10 (Invention)

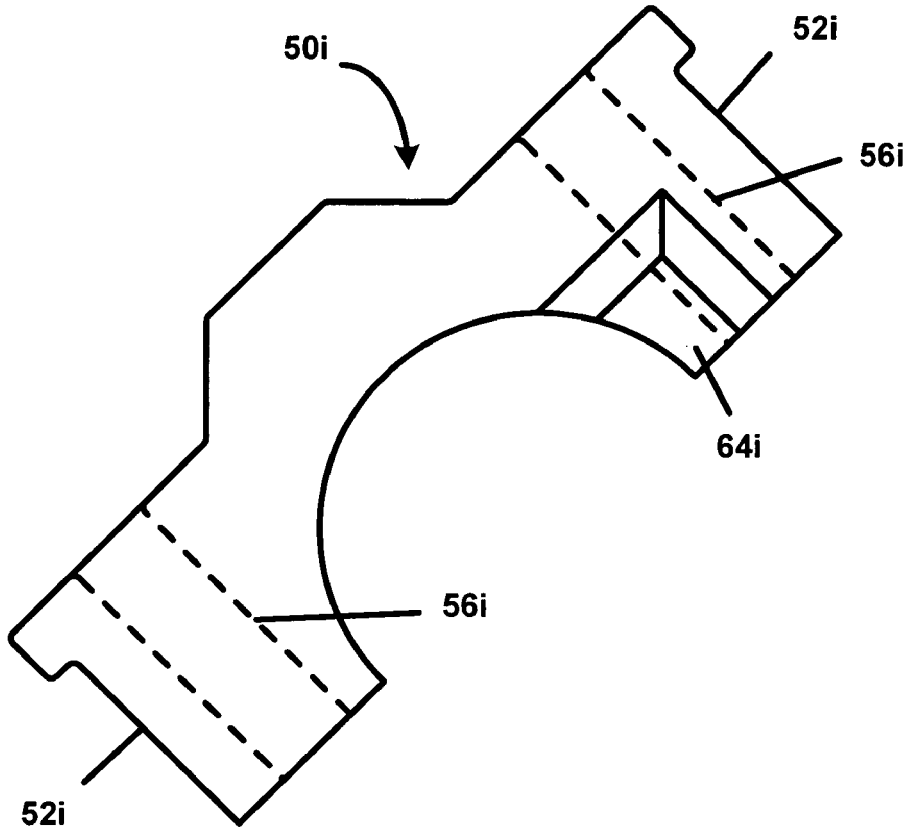
Fig. 11 (Invention)
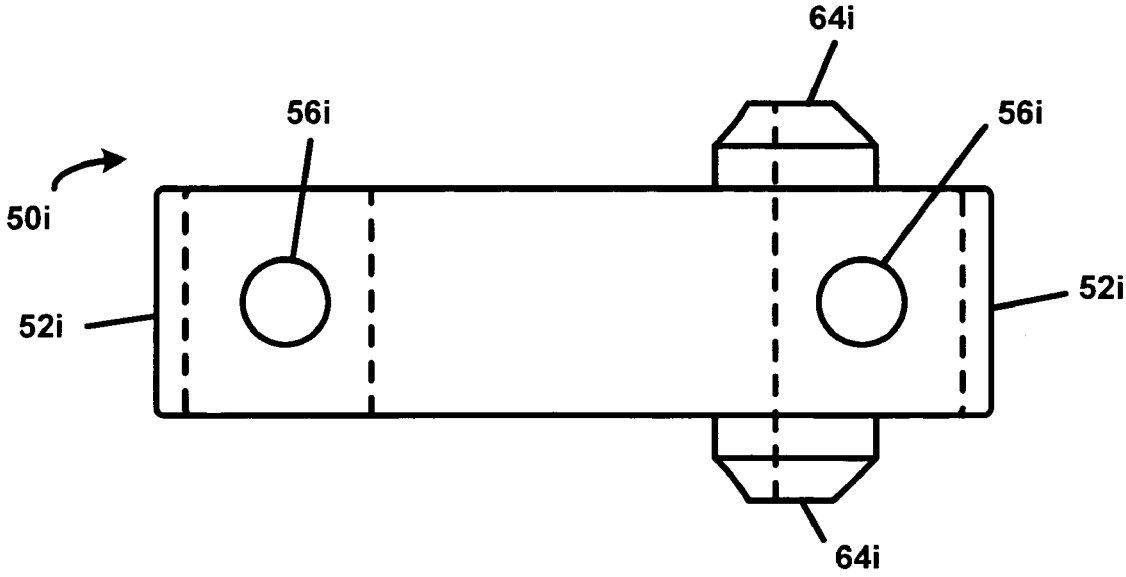
Fig. 12 (Invention)

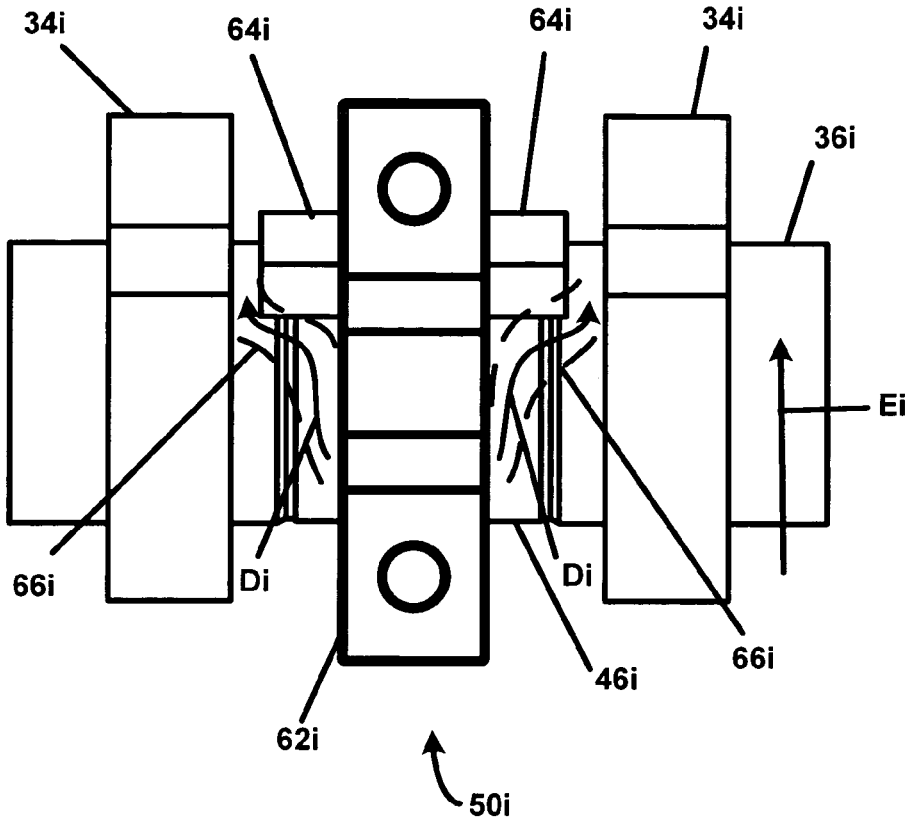
Fig. 17 (Invention)
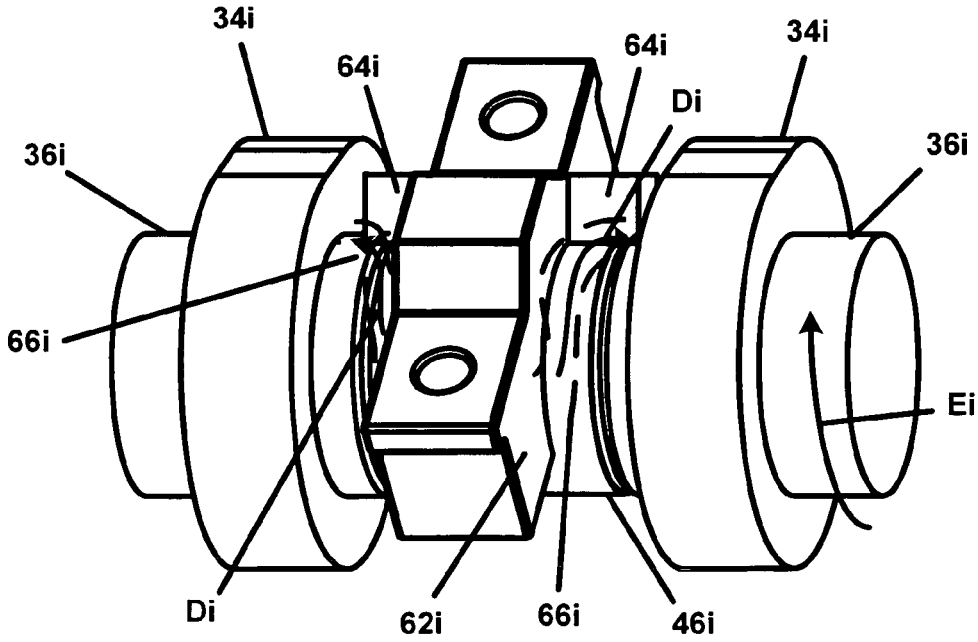
Fig. 18 (Invention)

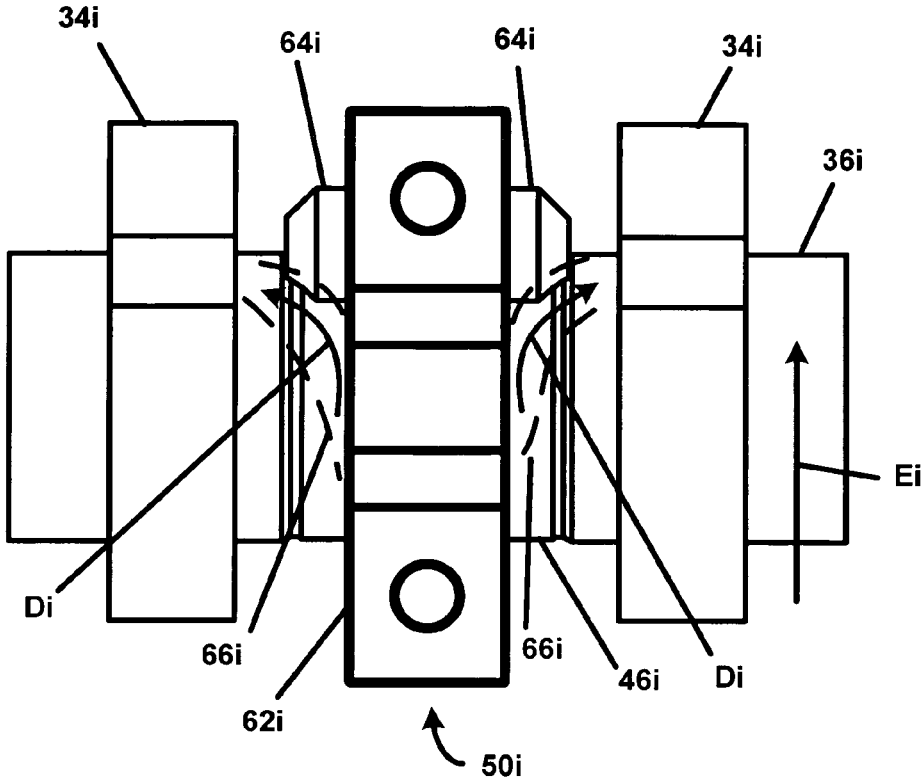
Fig. 19 (Invention)
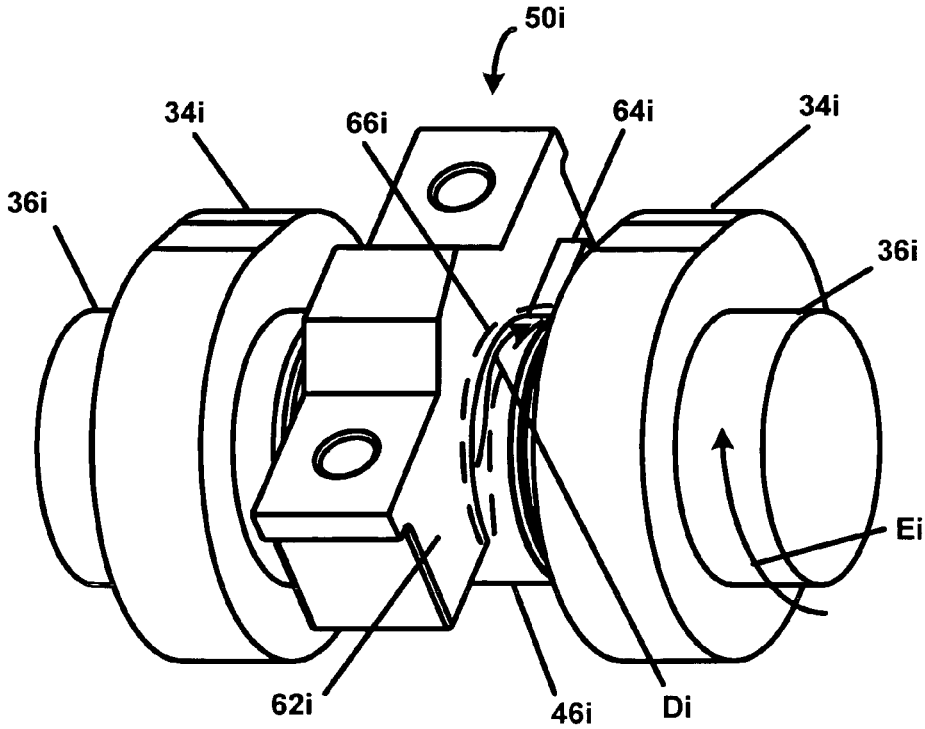
Fig. 20 (Invention)

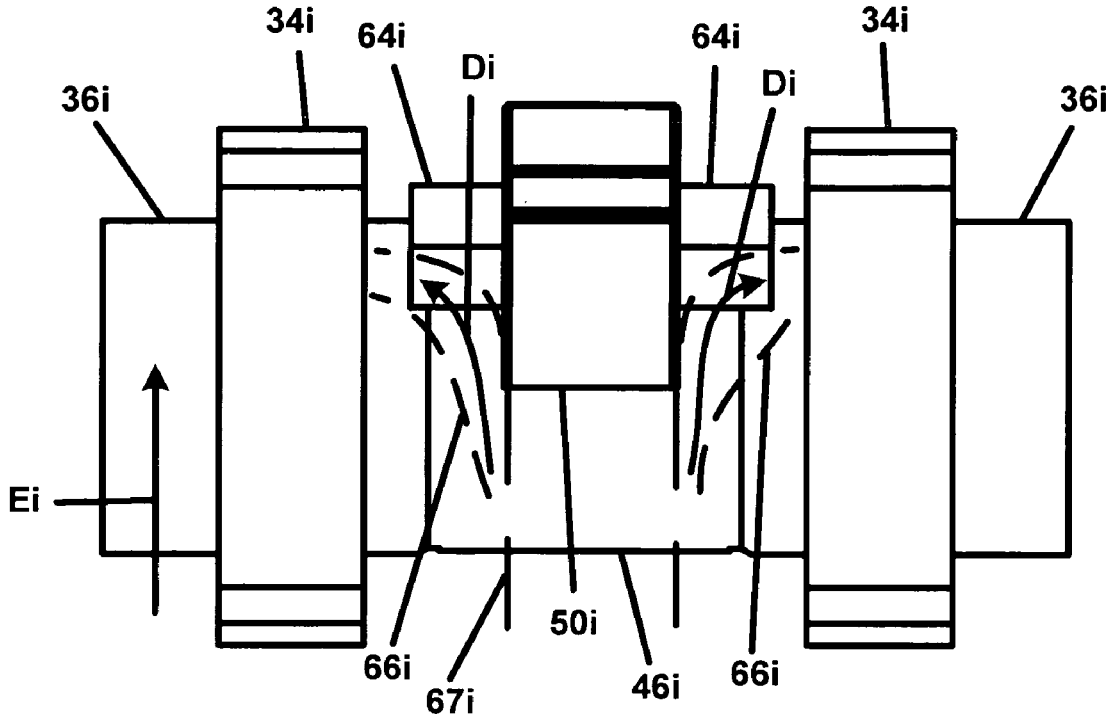
Fig. 21 (Invention)
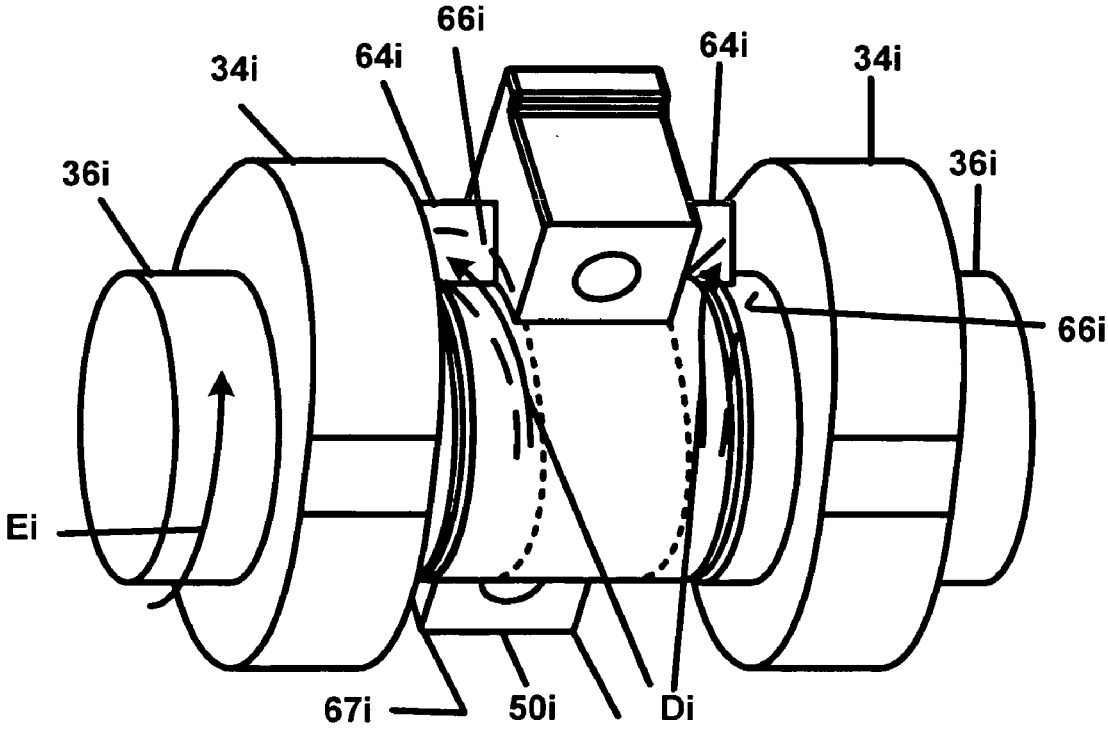
Fig. 22 (Invention)

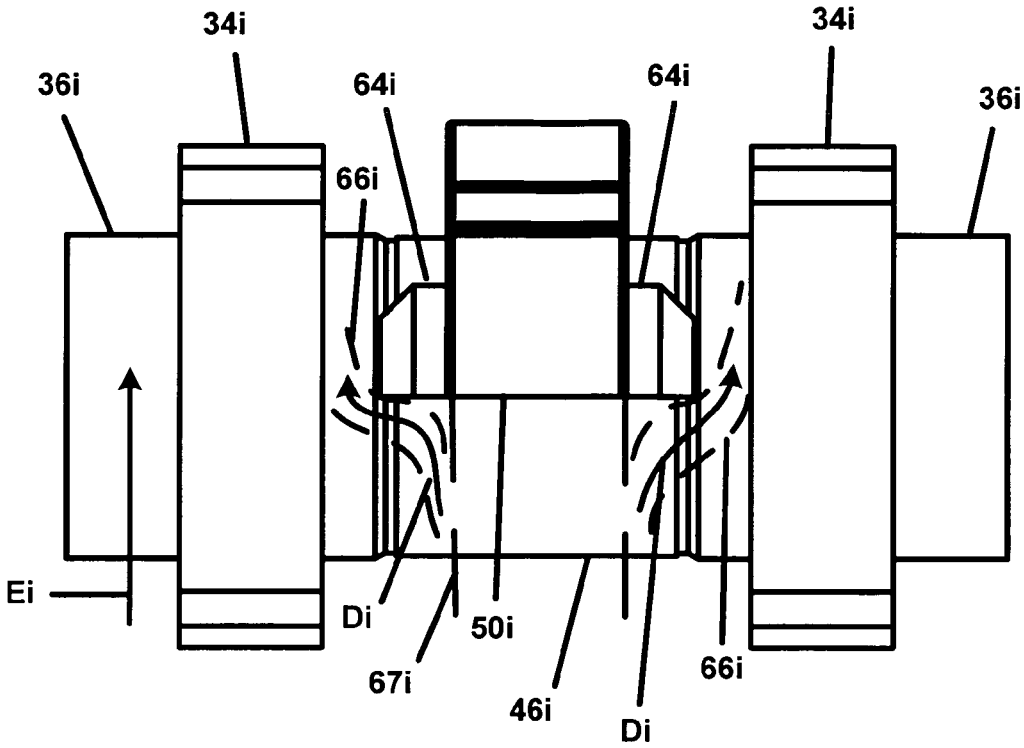
Fig. 23 (Invention)
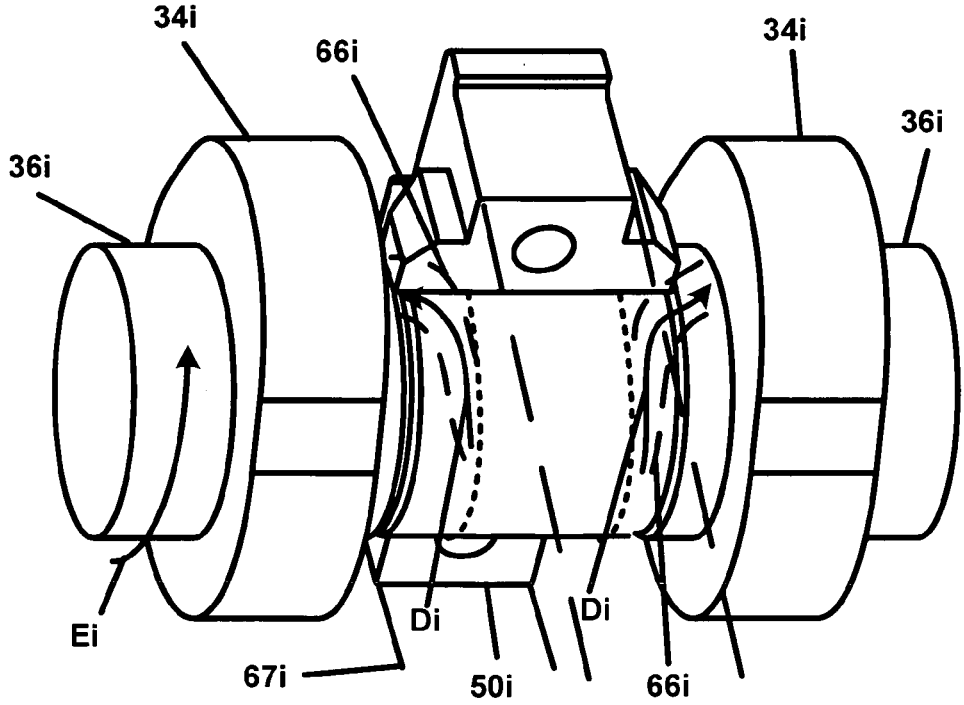
Fig. 24 (Invention)

VERTICALLY ORIENTED CAMSHAFT CAP OIL DIVERTER

FIELD OF THE INVENTION

The present invention relates to an improved lubricating device for the cam lobes of camshafts in an internal combustion engine.

BACKGROUND OF THE INVENTION

A typical concern with valve train lubrication in internal combustion engines is assuring the furnishing of an adequate supply of oil on the cam lobes while the engine is operating at all engine conditions. When the camshaft, particularly in an overhead cam engine, is operating, it is critical that the cam lobes are well lubricated. Lubricating is typically done using the engine oil. Without adequate oil supply to the cam lobes, components can overheat and fail. Accordingly, an adequate supply of oil to lubricate the lobes is critical to an engine under all operating conditions and engine speeds, including low engine speeds.

An example of one current method of supplying oil is to allow oil to bleed off out of top holes in lash adjusters through holes in roller finger followers. The oil then flows by gravity along the top surface of the body of the roller finger follower toward the areas in need of lubrication. While this works acceptably for some geometries of cam and roller configurations, oil does not always flow properly for all configurations.

A difficulty occurs with those geometries of overhead cam engines when one of the two sets of valves is located above all but the valve contacting tip portion of the roller finger followers such that gravitational force will cause the oil to flow away from rather than toward the critical areas in need of lubrication. In other words, the oil will flow off of the roller finger follower and down to the tappet gallery floor, thus providing no lubrication to the cam lobes and roller of the roller finger follower.

Some attempted solutions to this problem include adding extra oil passages around the cams to supply oil directly to the cam lobes, at the added cost, added for weight for additional parts and loss of oil pressure in the overall system; or by adding parts that force oil to be sprayed onto the cams at the expense of additional parts and the resultant loss of oil pressure in the overall oil system. A prior art attempt to remedy the inadequacy in a 90 degree V-type automotive engine was found to divert an insufficient quantity of oil, to the camshaft lobe. Thus, a need exists for an oiling mechanism that will assure adequate oil supply to the cam lobes at all engine speeds while not losing oil pressure or adding significant cost increases.

SUMMARY OF THE INVENTION

The present invention contemplates an oiling mechanism for use in an internal combustion engine having a camshaft that includes a journal portion having oil supplied to its surface and a cam lobe portion. The oiling mechanism is comprised of at least one camshaft bearing member affixed to the engine about the camshaft journal portion. The oiling mechanism comprises a diverter affixed to the camshaft bearing member provided adjacent to the camshaft journal, whereby oil will be diverted from the camshaft journal toward the cam lobe.

An object of the present invention is to provide a mechanism for supplying an improved quantity of oil to the camshaft lobes of a camshaft in an engine that includes a diverter affixed to the camshaft bearing members.

Another object of the present invention is providing adequate oil supply to the cam lobes while not adding additional parts to the system.

An additional object of the present invention is to provide an arrangement that assures an adequate oil supply without losing pressure in the oil system at all engine speeds.

Additional objects and advantages will be apparent from the following detailed description.

BRIEF DESCRIPTION OF THE DRAWINGS

FIG. 9 is a side elevation view of a camshaft bearing cap with oil diverter pad re-oriented in accordance with the present invention, shown inclined as it would be in a 90 degree V-type engine.

FIG. 10 is a plan view of a camshaft bearing cap of FIG. 9.

FIG. 11 is a side elevation view of an alternative camshaft bearing cap in accordance with the present invention, shown inclined as it would be in a 90 degree V-type engine.

FIG. 12 is a plan view of a camshaft bearing cap of FIG. 11.

FIG. 17 is a plan view of a camshaft bearing cap and a camshaft in accordance with the present invention illustrating the flow of oil.

FIG. 18 is an isometric view of a camshaft bearing cap and camshaft in accordance with the present invention showing the camshaft bearing cap inclined as it would be in a 90 degree V-type engine illustrating the flow of oil.

FIG. 19 is a plan view of an alternative camshaft bearing cap and a camshaft in accordance with the present invention illustrating the flow of oil.

FIG. 20 is an isometric view of a camshaft bearing cap of FIG. 19 showing the camshaft bearing cap inclined as it would be in a 90 degree V-type engine illustrating the flow of oil.

FIG. 21 is an elevation of a camshaft bearing cap and a camshaft of the kind shown in FIG. 17 and partially rotated illustrating the flow of oil when the camshaft is rotating in the opposite direction as compared to FIG. 17.

FIG. 22 is an isometric view of a camshaft bearing cap and a camshaft of FIG. 21 inclined as it would be in a 90 degree V-type engine and illustrating the flow of oil.

FIG. 23 is an elevation of a camshaft bearing cap and a camshaft of the kind shown in FIG. 19 and partially rotated illustrating the flow of oil when the camshaft is rotating in the opposite direction as compared to FIG. 19.

FIG. 24 is an isometric view of a camshaft bearing cap and camshaft of FIG. 23 showing the camshaft bearing cap inclined as it would be in a 90 degree V-type engine illustrating the flow of oil.

DETAILED DESCRIPTION OF THE PREFERRED EMBODIMENTS

Figure 1:
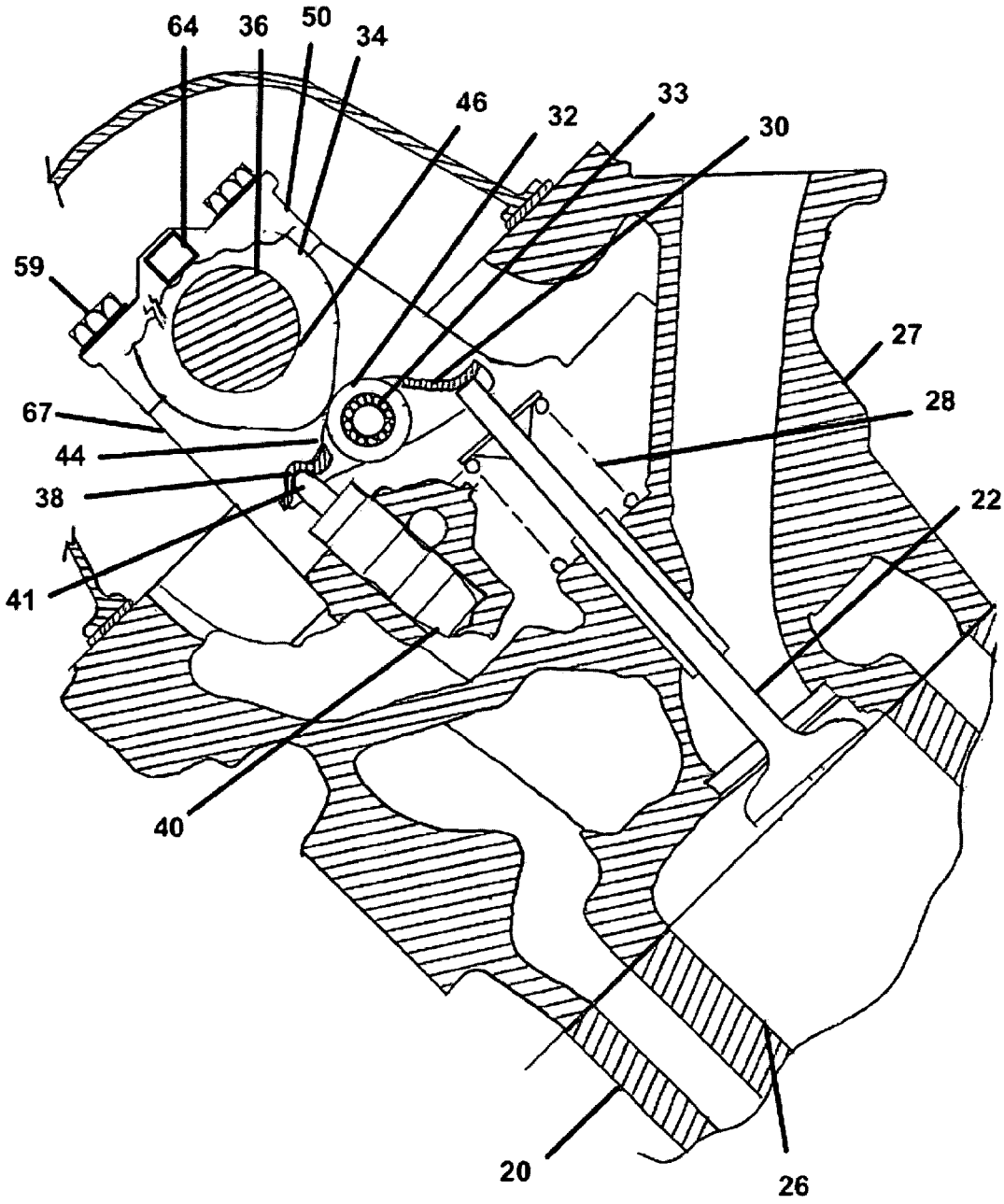
Fig. 1 (Prior Art)
FIG. 1 is an elevation view illustrating in partial section of a prior art engine.
Figure 2:
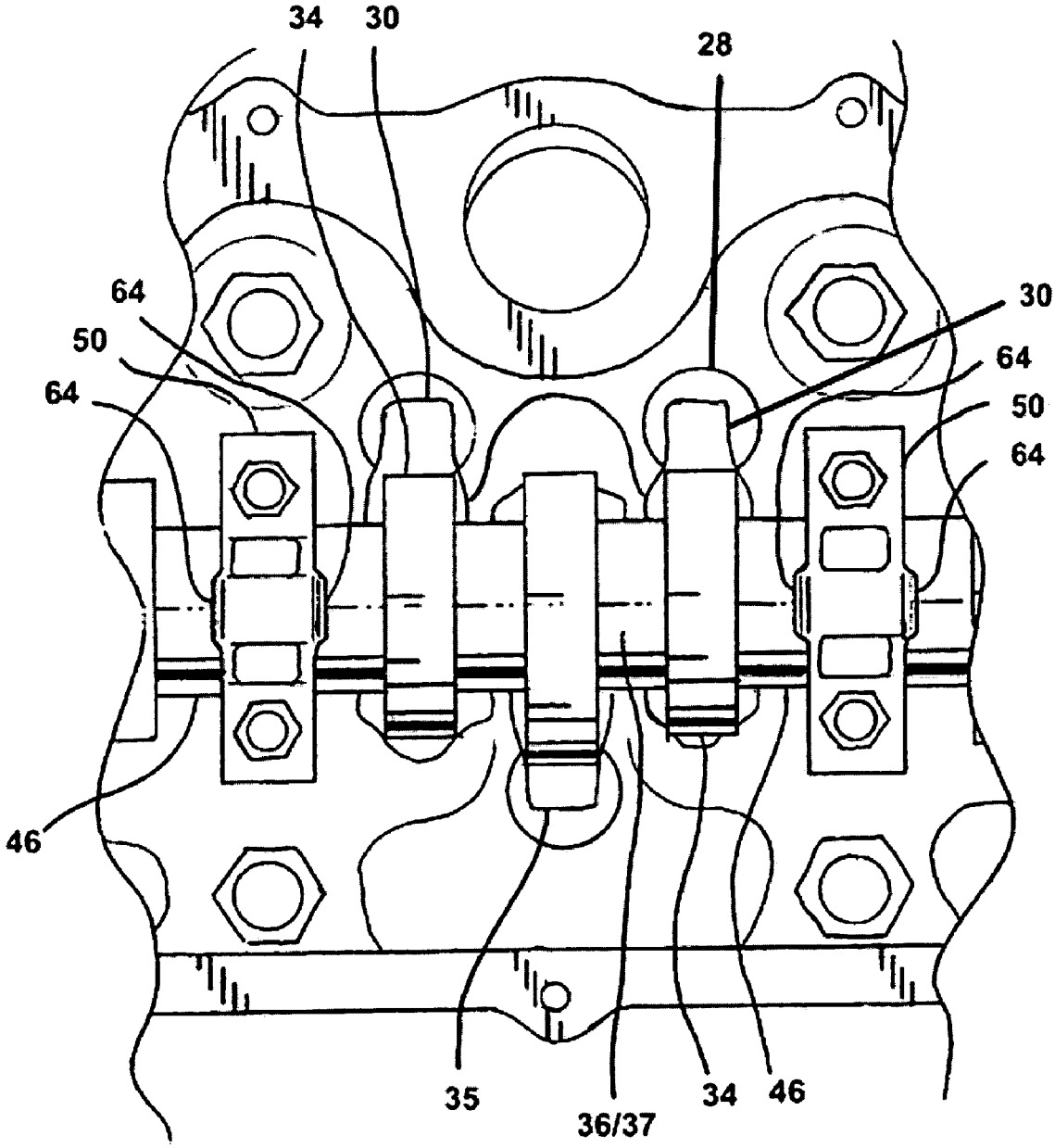
Fig. 2 (Prior Art)
FIG. 2 is a partial plan view of a prior art cylinder head of a single overhead cam engine, with the lash adjusters not shown.

Referring to FIGS. 1 and 2, a portion of an internal combustion engine 20 is shown having a single overhead camshaft 36. Conventional intake valves 22 and exhaust valves (not shown), are mounted in a cylinder head 27, each of which has a head located within one of the cylinders 26 of engine 20. Each of the valves 22 is biased in a closed position (although illustrated in the open position) by a spring 28. A roller finger follower 30 is in surface contact with the back end of each of the valves. Each of the roller finger followers 30 has a roller 32, in contact with either an intake cam lobe 34 or an exhaust cam lobe 35 (shown in FIG. 2) on the camshaft 36, and an adjustment portion 38 that is often referred to as a "ball socket" into which the end of a lash adjuster seals and that is in surface contact with the lash adjuster 40. Each of the rollers 32 includes a series of needle bearings 33 to promote rotation of rollers 32.

Each lash adjuster 40 includes a top hole 41, shown in FIG. 1 through which oil bleeds off and then runs along the top surface 42 of the stamped body 44 of the corresponding roller finger follower 30 under a gravitational force. The top hole 41 of the roller finger follower 30 associated with the exhaust valves (not shown) is positioned vertically higher than the line of contact between the exhaust cam lobes 35 and the rollers 32 while the top hole 41 of the roller finger follower 30 associated with the intake valves 22 is vertically below the line of contact between the intake cam lobes 34 and the rollers 32.

With an engine configuration of this kind, the oil that bleeds off of the lash adjusters 40 associated with the exhaust valves (not shown) will then run down to and wet the surfaces of roller 32. As this occurs, the contact between the rollers 32 and the associated intake cam lobes 34 will be constantly wetted with oil. On the other hand, the oil that bleeds off of the lash adjusters 40 associated with the intake valves 22 will run down to the tappet gallery floor, thus providing no lubrication to the intake cam lobes 34 and roller 32 of the roller finger followers 30 from this supply of oil.

Surrounding the top portion of and retaining the camshaft 36 are camshaft bearing caps 50. The bearing caps 50 are located adjacent to the cam lobes 34. The bearing caps 50 are in proximate surface contact with the camshaft journal 46, having only about a 0.02 millimeter gap between the bearing cap 50 and camshaft journal 46, allowing for a thin film of oil in the gap. The camshaft journals 46 contain oil upon their outer surface due to oil leaking from the bearing caps 50.

Figure 5:
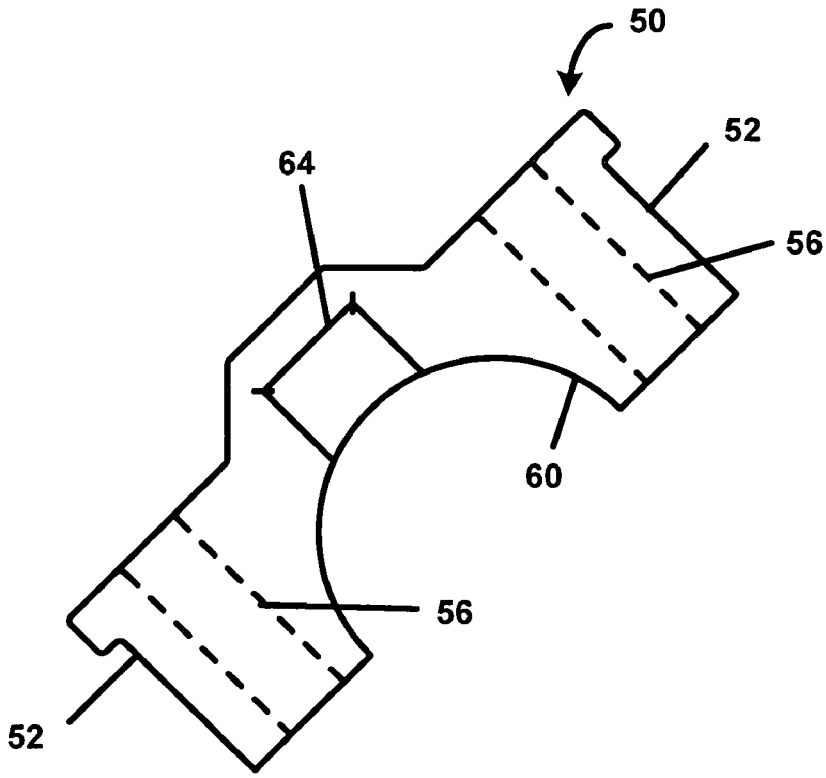
Fig. 5 (Prior Art)
FIG. 5 is a side elevation view of a prior art camshaft bearing cap shown inclined as it would be in a 90 degree V-type engine.
Figure 6:
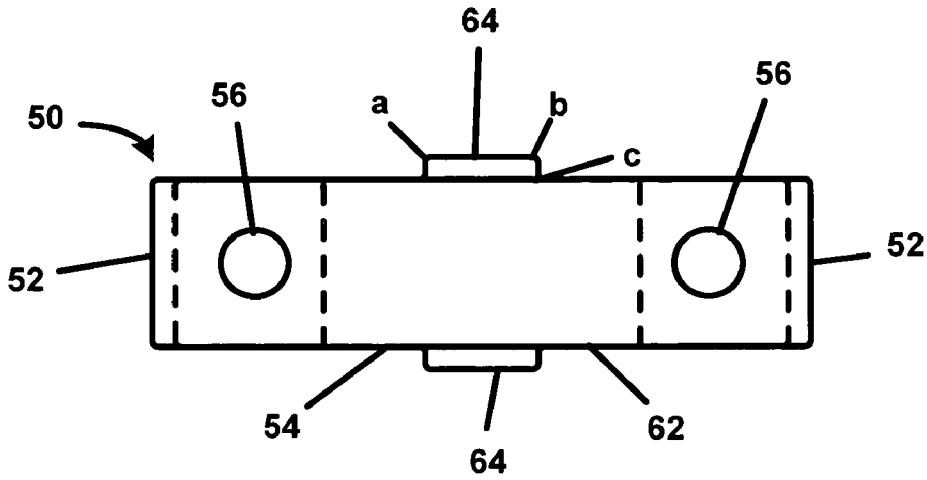
Fig. 6 (Prior Art)
FIG. 6 is a plan view of a camshaft bearing cap of FIG. 5.

Details of the prior art bearing cap 50 are further illustrated in FIGS. 5 and 6. Each bearing cap 50 is made up of two end portions 52 and a central portion 54. Each of the end portions 52 has a bore 56 therethrough and a locating dowel (not shown) protruding from one end of the bore 56. The protruding portion of the locating dowels (not shown) fit into corresponding bores (not shown) in the engine on either side of the camshaft journal 46, where fasteners 59 can be inserted to install and maintain the bearing caps 50 in place. When installed, a semi-circular bearing surface 60 within the central portion 54 of the bearing caps 50 is approximately 0.02 millimeters from surface contact with the camshaft journal 46 as described above.

The side surfaces 62 of the central portion of bearing cap 50 are generally flat and normal to the direction of rotation of the camshaft 36. Protruding from each side of the central portion 54 of the bearing caps 50 are oil diverter pads 64. Prior art indications are that the oil diverter pads 64 preferably extend to and form a part of the semi-circular bearing surface 60 and, alternatively, that the oil diverter pads 64 can be recessed slightly from the bearing surface 60, so long as this additional gap formed is minimal, allowing oil to still be diverted by the pads 64. The oil diverter pads 64 are preferably but not necessarily formed integrally with the camshaft bearing caps 50 for ease of manufacture.

In prior art teachings, the width (i.e., the distance from point a to point b, shown in FIG. 6) of a pad 64 has only a small effect upon the flow of oil from camshaft journal 46. Therefore, the width can be determined based upon ease of fabrication and assembly so long as it is wide enough to withstand the forces encountered in operation. A width between 3 and 12 millimeters appears preferable.

Additionally, the prior art indicates a thickness (i.e., the distance from point b to point c, shown in FIG. 6) of a pad 64 can also vary and, in general, that the thicker the pad 64, the quicker the oil will be diverted from the surface of the camshaft journal 46 to the cam lobes 34. The minimum thickness is preferably greater than 1 millimeter; and the maximum thickness is a tradeoff of manufacturing considerations, including fabrication and the space available for the pad 64 to protrude without interfering with the operation of the cam lobes 34 and 35, while still minimizing the time to divert the oil. The preferred thickness indicated is between 1 and 3 millimeters.

Figure 13:
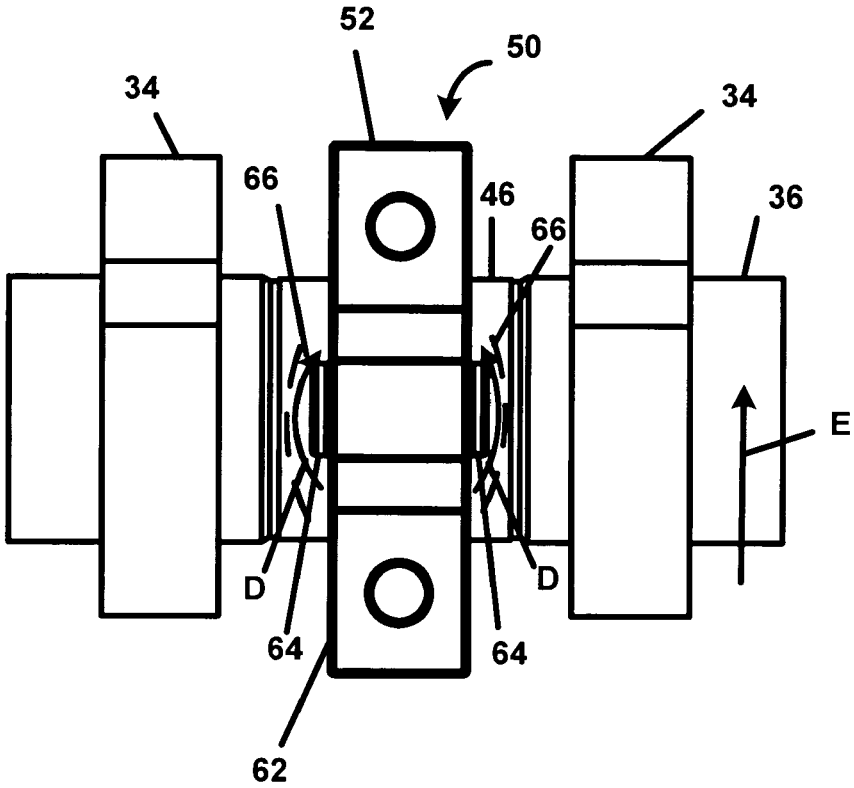
Fig. 13 (Prior Art)
FIG. 13 is a plan view of a prior art camshaft bearing cap and camshaft illustrating the flow of oil.
Figure 14:
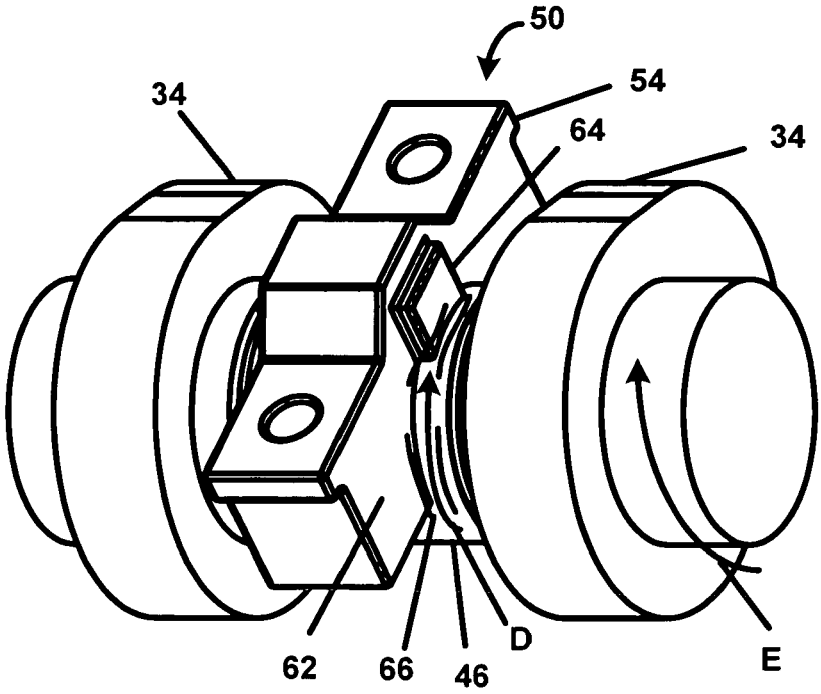
Fig. 14 (Prior Art)
FIG. 14 is an isometric view of a camshaft bearing cap and camshaft of FIG. 13 shown inclined as it would be in a 90 degree V-type engine illustrating the flow of oil.

Application of the prior art in a 90 degree V-type engine shown in FIGS. 13 and 14 has demonstrated that the centrally located oil diverter pad 64 does not adequately divert oil 66 substantially away from the camshaft cap 50 to the adjacent camshaft lobe 34. The flow (addressed by Arrow D) of oil 66 flows around the oil diverter 64 and never leaves the side surface 62 of the camshaft cap 50. This phenomenon occurred regardless of the direction of rotation as shown by Arrow E.

Figure 7:
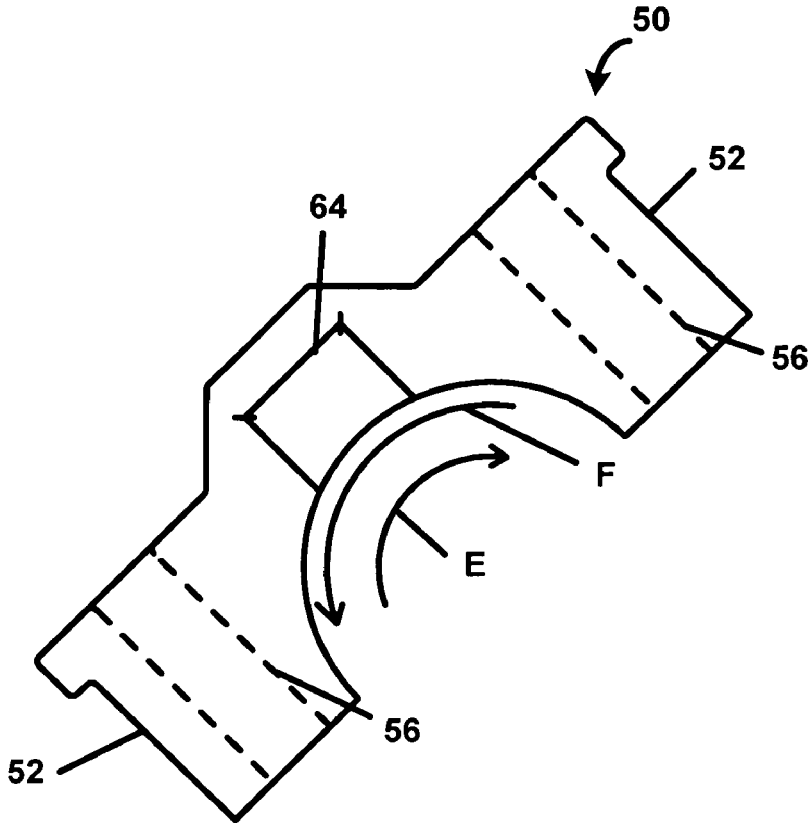
Fig. 7 (Prior Art)
FIG. 7 is a side elevation view of a prior art camshaft bearing cap shown inclined as it would be in a 90 degree V-type engine.
Figure 8:
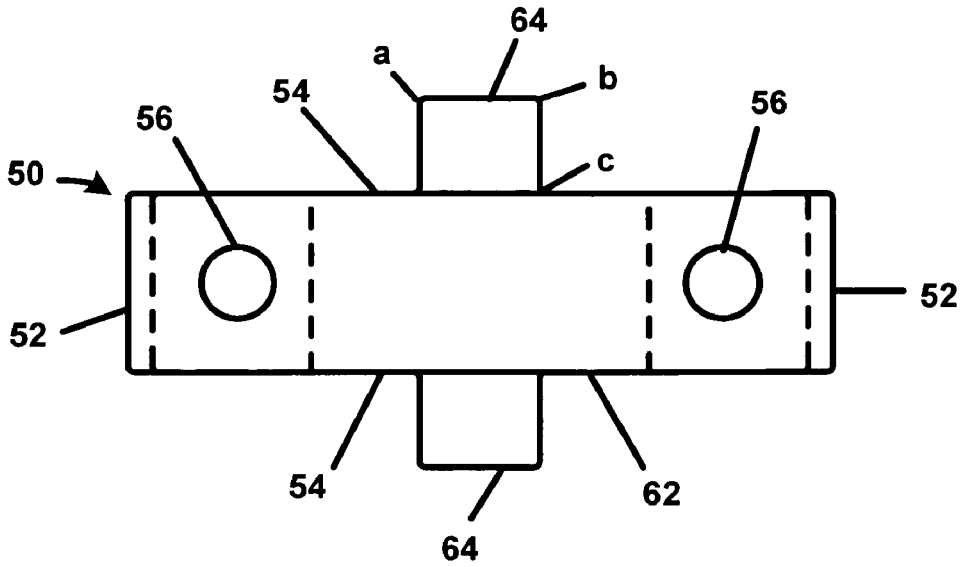
Fig. 8 (Prior Art)
FIG. 8 is a plan view of the camshaft bearing cap of FIG. 7.
Figure 15:
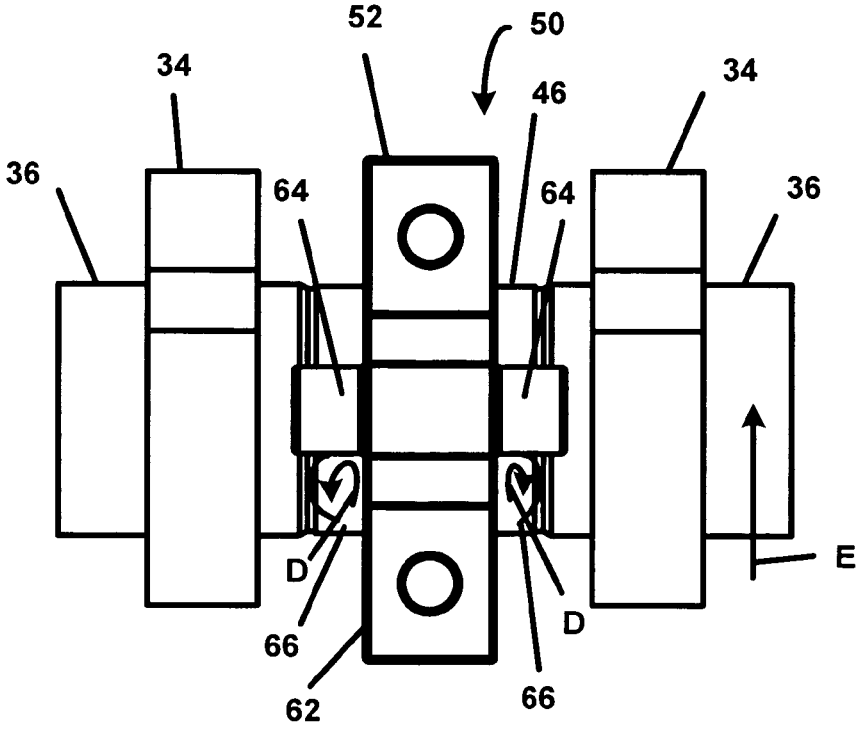
Fig. 15 (Prior Art)
FIG. 15 is a plan view of a prototype prior art camshaft bearing cap and a camshaft illustrating the flow of oil.
Figure 16:
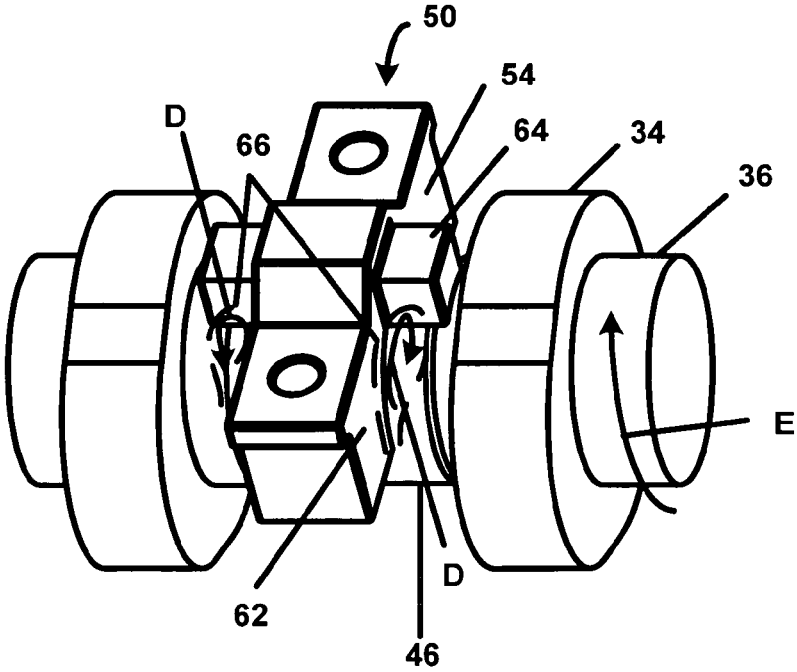
Fig. 16 (Prior Art)
FIG. 16 is an isometric view of a camshaft bearing cap and camshaft of FIG. 15, inclined as it would be in a 90 degree V-type engine illustrating the flow of oil.

An exaggerated version of prior art was made as a prototype camshaft cap 50 with a 7 mm thickness (distance between points b and c) as shown in FIGS. 7 and 8. The prototype camshaft cap 50 was in accordance with prior art with the exception of the thickness of the oil diverter pad 64. The centrally located oil diverter pads 64 were effective in directing oil 66 to the adjacent camshaft lobes 34 when the camshaft 36 was rotated in a direction E counter to what is illustrated in FIGS. 15 and 16. However, when the camshaft 36 is rotated in direction E, while oil 66 flows from the side surface 62 of the camshaft cap 50 (shown by D) and is diverted by the oil diverter pad 64 not to the camshaft lobe 34, but back toward the side surface 62 of the camshaft cap 50 and down the camshaft tower 67.

The foregoing description of known prior art embodiments and teaching indicates the inadequacy of adequate lubricating capabilities of the known configurations.

In accordance with the invention, it has been discovered that the relocations (reorientation of oil diverter pads results in a more efficient and broader distribution of the lubricating oil function.

In the description of the invention as depicted in FIGS. 3, 4, 9-12, and 17-24, reference numbers followed by the lower case ("i"), unless otherwise indicated, function essentially as described to the same numbers (without "i") applied, as described hereinabove to the prior art figures of the drawing.

Figure 3:
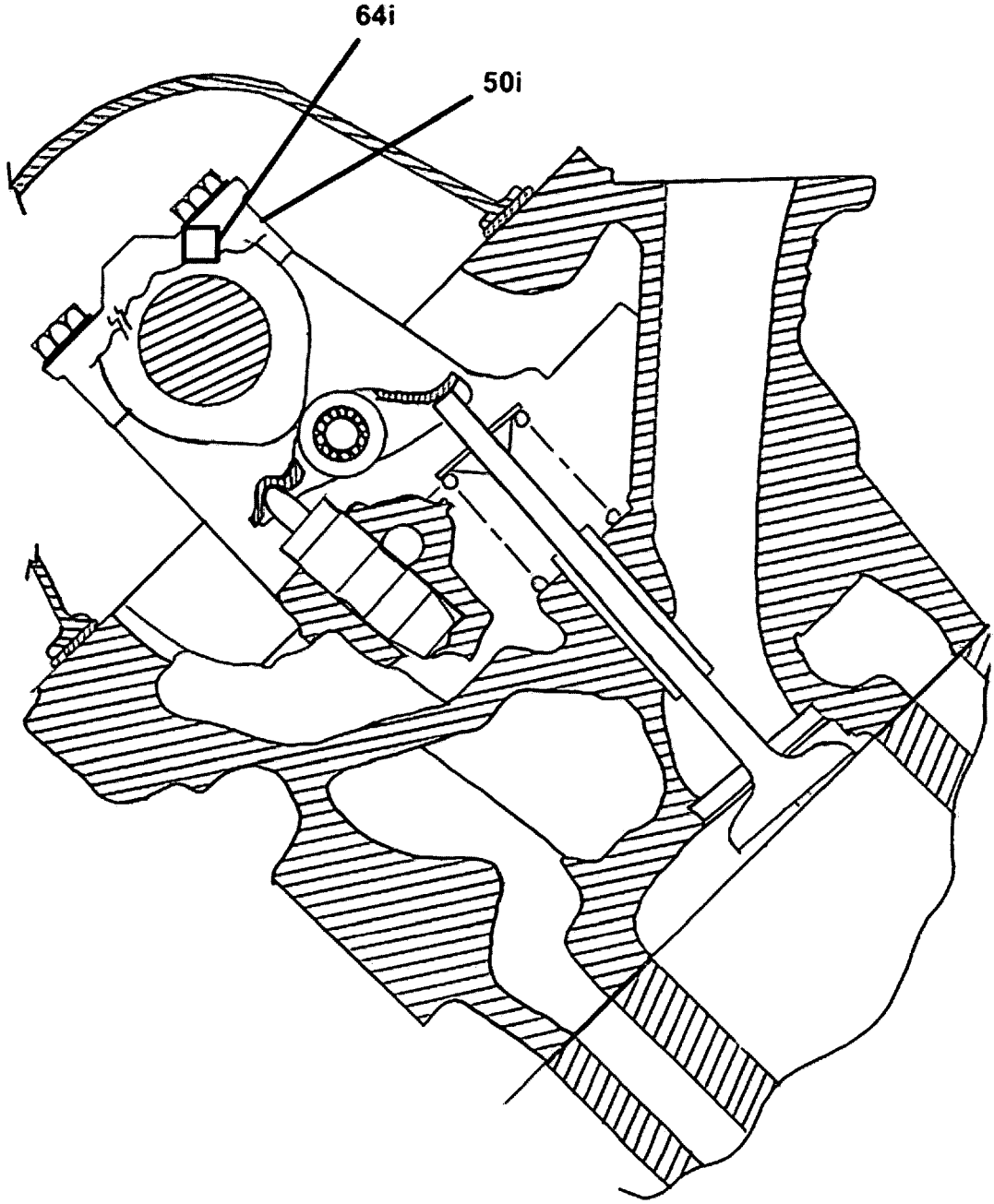
FIG. 3 is an elevation view in partial section of an engine in accordance with the present invention.
Figure 4:
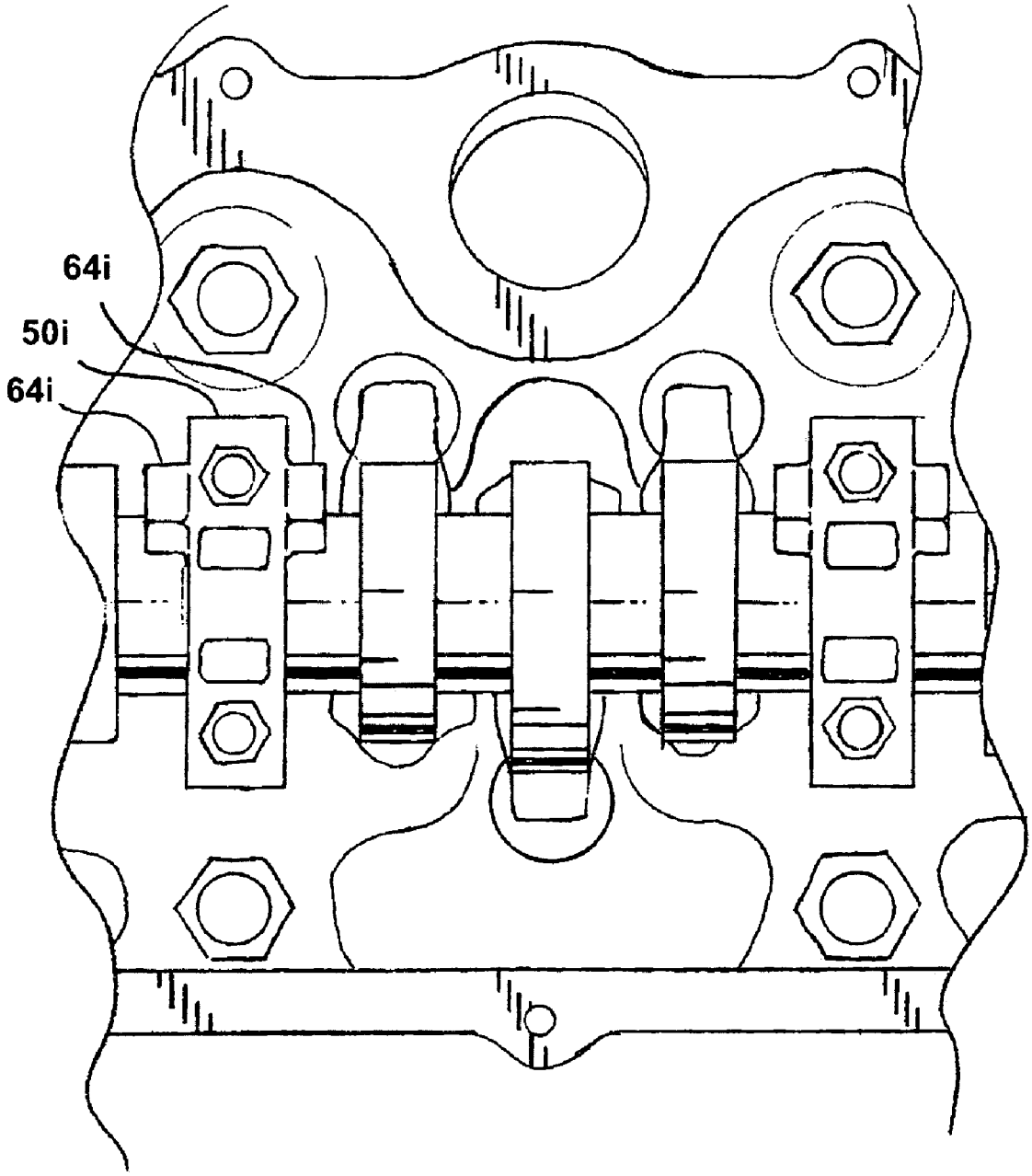
FIG. 4 is a partial plan view of a cylinder head of a single overhead cam engine with lash adjusters not shown, in accordance with the present invention.

The invention as seen by reference to FIGS. 3, 4, 7-12 and 17-24 and as illustrated more particularly by reference to FIGS. 9 and 10 involves a relocation of the oil diverter pads 64 from the central portion 54 of the camshaft cap 50 towards one end 52 of the camshaft cap 50 such that the oil diverter 64 is in a vertical position when the camshaft cap 50 is installed on the engine 20 as shown in FIGS. 3, 4 and 9. I have discovered that with the oil diverter pad 64 in this position, oil 66 is diverted along a path (as shown by D) away from the camshaft cap 50 toward the adjacent camshaft lobe 34 where it is needed when the camshaft 36 rotates in a direction E. FIGS. 21 and 22 illustrate the relationship of the direction of camshaft 36 rotation E for the other cylinder bank of a V-type engine. The invention has been found to surprisingly and effectively divert the oil 66 along a path D from the camshaft cap 50 toward the camshaft lobe 34 when the camshaft 36 rotates in the opposite direction E as compared to FIGS. 17 and 18.

As an alternative and further advantage the revised configuration of the invention is amenable to a "casting-friendly" design as shown in FIGS. 11 and 12, so that the camshaft cap 50 can divert the oil 66 away from the camshaft cap 50 toward the camshaft lobe 34 when the camshaft 36 rotates in either direction E. This is illustrated in FIGS. 19, 20, 23, and 24. What is unique to the "casting-friendly" design characterization is that there are multiple planes that can be used to divide a top portion and a bottom portion of the camshaft cap. Any one of these planes is capable of representing an interface plane between an upper and lower casting die from which the basic camshaft cap shape can be cast. This design development facilitates and eases mass production of cast camshaft caps.

While the best mode for carrying out the invention has been described in detail, those familiar with the art to which this invention relates will recognize various alternative designs and embodiments for practicing the invention as defined by the following claims.

I claim:

1. In an internal combustion engine comprising in combination a camshaft, a camshaft bearing, a cam lobe, a journal and and a gravitational force oiling mechanism comprising an oil diverter with pad, the improvement comprising a non-centrally located oil diverter affixed to the camshaft bearing and having the oil diverter pad protruding from a portion of the bearing member to effect a modified oil diversion diverted from the camshaft journal toward the cam lobe.

2. The engine of claim 1 wherein the non-centrally located oil diverter is located at a point near vertical where the camshaft cap is inclined at an angle of 25 degrees or greater with respect to horizontal on a global frame of reference.

3. The engine according to claim 1, wherein the diverter comprises two oil diverter pads protruding from opposite sides of a non-central portion at a point near vertical of the bearing member.

4. A mechanism according to claim 1, wherein the camshaft bearing member has two spaced end portions affixed to the engine and a central portion therebetween, the diverter is affixed to the non-central portion at a point near vertical of the bearing member.

5. A mechanism according to claim 1, wherein the camshaft bearing member has two spaced end portions affixed to the engine and a central portion therebetween, the diverter being affixed to the non-central portion at a point near vertical of the bearing member.

6. In combination, an internal combustion engine and an oiling mechanism comprising:

a. a camshaft which includes a cam lobe portion and a journal portion having oil supplied to a surface of the journal;

b. at least one camshaft bearing member affixed to the engine about the camshaft journal portion; and c. a diverter non-centrally positioned and affixed to the camshaft bearing member provided adjacent to the camshaft journal, the diverter comprises at least one oil diverter pad protruding from a portion of the bearing member wherein oil will be diverted from the camshaft journal toward the cam lobe.

7. A combination according to claim 6, wherein the diverter comprises two oil diverter pads protruding from opposite sides of a non-central portion at a point near vertical of the bearing member.

8. A non-centrally located oil diverter according to claim 6 positioned at a point near vertical which has several horizontal planes of the cam shaft cap including the diverter pads that are consistent with the projection of the plan view of the cam shaft cap, and wherein anyone of the planes pad can represent a separation plane between the upper and lower die halves of a formed camshaft cap.

* * * * *